US009242332B2

(12) United States Patent
Junker et al.

(10) Patent No.: US 9,242,332 B2
(45) Date of Patent: Jan. 26, 2016

(54) METHOD FOR THE CYLINDRICAL GRINDING OF A WORKPIECE, SYSTEM CONTAINING THE WORKPIECE AND APPARATUS FOR THE CENTRELESS GRINDING OF THE SYSTEM

(75) Inventors: Erwin Junker, Buehl (DE); Hubert Mueller, Nordrach (DE)

(73) Assignee: Erwin Junker Grinding Technology A.S., Melnik (CZ)

( * ) Notice: Subject to any disclaimer, the term of this patent is extended or adjusted under 35 U.S.C. 154(b) by 270 days.

(21) Appl. No.: 13/820,246

(22) PCT Filed: Aug. 30, 2011

(86) PCT No.: PCT/EP2011/064879

§ 371 (c)(1),
(2), (4) Date: Mar. 18, 2013

(87) PCT Pub. No.: WO2012/028604

PCT Pub. Date: Mar. 8, 2012

(65) Prior Publication Data

US 2013/0210322 A1 Aug. 15, 2013

(30) Foreign Application Priority Data

Sep. 1, 2010 (DE) ..... 10 2010 036 065

(51) Int. Cl.

| | |
|---|---|
| ***B24B 5/35*** | (2006.01) |
| ***B24B 5/42*** | (2006.01) |
| ***B24B 41/00*** | (2006.01) |
| ***B24B 5/00*** | (2006.01) |
| ***B24B 1/00*** | (2006.01) |
| ***B24B 5/22*** | (2006.01) |

(52) U.S. Cl.
CPC ... *B24B 5/00* (2013.01); *B24B 1/00* (2013.01); *B24B 5/22* (2013.01); *B24B 5/35* (2013.01); *B24B 5/428* (2013.01); *B24B 41/007* (2013.01)

(58) Field of Classification Search
CPC ..... B24B 5/02; B24B 5/04; B24B 5/18; B24B 5/35; B24B 5/42; B24B 5/428; B24B 19/12
See application file for complete search history.

(56) References Cited

U.S. PATENT DOCUMENTS 3,358,310 A * 12/1967 Wrobbel ..... 15/97.1
4,578,906 A * 4/1986 Appleton ..... 451/355

(Continued)

FOREIGN PATENT DOCUMENTS

| | | |
|---|---|---|
| CN | 201283519 | 8/2009 |
| GB | 2 206 299 | 1/1989 |

(Continued)

*Primary Examiner* — Monica Carter
*Assistant Examiner* — Lauren Beronja
(74) *Attorney, Agent, or Firm* — Jordan and Hamburg LLP

(57) ABSTRACT

On a workpiece there are first longitudinal portions which are rotationally symmetrical with respect to the continuous longitudinal axis and are intended to be ground by way of centerless grinding. The workpiece also has a second longitudinal portion, which is not rotationally symmetrical with respect to the longitudinal axis and would lead to imbalance in the event of rotation. Therefore, a balancing weight having a radially extending recess is placed on the second longitudinal portion. The balancing weight contributes largely to uniform distribution of the rotating masses, thus reduces the imbalance to a very low residual imbalance and allows reliable and precise centerless grinding.

5 Claims, 6 Drawing Sheets

(56) References Cited

U.S. PATENT DOCUMENTS

| | | | | |
|---|---|---|---|---|
| 7,258,594 | B2 * | 8/2007 | Junker | 451/5 |
| 2004/0248502 | A1 * | 12/2004 | Junker | 451/11 |

FOREIGN PATENT DOCUMENTS

| | | |
|---|---|---|
| JP | 56-56373 | 5/1981 |
| JP | 9-314447 | 12/1997 |

* cited by examiner

METHOD FOR THE CYLINDRICAL GRINDING OF A WORKPIECE, SYSTEM CONTAINING THE WORKPIECE AND APPARATUS FOR THE CENTRELESS GRINDING OF THE SYSTEM

BACKGROUND OF THE INVENTION

The invention relates to a method for the cylindrical grinding of a one-piece workpiece, the contour of which is defined by a continuous longitudinal axis and, in addition to a first longitudinal region, which is cylindrical with respect to said longitudinal axis, also has a second longitudinal region, in which the radial distribution of mass in relation to the longitudinal axis is non-uniform.

Workpieces of this kind are known. They are contoured in accordance with a continuous longitudinal axis, this longitudinal axis simultaneously being a center line and an axis of rotation during subsequent operation. However, only some of them have one or more longitudinal portions of cylindrical cross section which are rotationally symmetrical in relation to the longitudinal axis. In another longitudinal region, the radial distribution of mass is non-uniform because the radial circumferential contour is eccentric or not rotationally symmetrical in some other way with respect to the longitudinal axis. The best-known example of such workpieces are the balancer shafts in modern engines, especially those for motor vehicles. The increasing use of such balancer shafts is the product of the mutually contradictory demands for smoothness from these engines, for low fuel consumption data and for lightweight construction in general. However, the use of balancer shafts is not restricted only to motor vehicle engines but also extends to compressors and other technical areas.

In the specialist jargon of those in the industry, such workpieces are referred to as "unbalanced". This means that a workpiece of this kind rotating alone is associated with problems of unbalance since the rotary motion is non-uniform and is disturbed by vibrations or wobbling movements. With the increasing use of balancer shafts and similar workpieces, there arose the demand for high-precision grinding of said workpieces, at least in the cylindrical and rotationally symmetrical longitudinal regions thereof, in an economical production process, despite the unbalance behavior thereof.

There have already been various reflections on how this demand could be met with the known means of grinding technology. The knowledge of the applicant on the subject is made up of its own operational practice, from analyses of in-house tests and from discussions among professionals of the kind which customarily take place at specialist conferences, exhibitions and similar occasions. There is no known documentation or publication relating thereto, however.

Thus, consideration was given to producing said workpieces selectively with a considerable allowance in the second longitudinal region thereof in such a way that an approximation to rotational symmetry and hence smooth concentric running would be expected. After grinding, the excess allowance would have had to be removed. However, such a grinding method would be not only very involved and expensive but would also entail a reduction in quality. This is because removal of material by turning or milling after grinding, the latter being a fine machining process, would lead to distortion of the workpiece, making it impossible to comply with the required dimensional and shape tolerances.

The idea of grinding these difficult workpieces by mounting between centers had to be abandoned. It would be expected that grinding said workpieces between centers would be possible only with considerable outlay owing to their instability and the workpiece geometry. For example, an axial contact pressure of the kind which generally arises when grinding between centers would have led to deformation precisely of the weak, eccentric second longitudinal region.

Finally, the tried and tested method for centerless cylindrical grinding was also considered. In this case, however, the experience hitherto has been almost exclusively with completely rotationally symmetrical workpieces. It was therefore known that a relatively severe unbalance of the workpieces made this grinding process very difficult or even impracticable. During centerless cylindrical grinding, an "unbalanced" workpiece will rotate nonuniformly, that is to say will not allow a uniform rotary motion to take place. This means, first of all, an inaccurate grinding result. It was even necessary to accept that the nonuniform rotary motion would even hinder the driving of the workpiece by the regulating wheel, not even allowing the rotary driving of the workpiece to come about. As is known, conditions in the grinding gap are so difficult that the regulating wheel can only transmit a sufficient torque to the workpiece if the latter is by and large also rotationally symmetrical with respect to the distribution of mass. However, if the drive is not reliable for the process from the outset, centerless cylindrical grinding cannot even be considered for these workpieces.

SUMMARY OF THE INVENTION

It is therefore the underlying object of the invention to provide a method for cylindrical grinding by means of which the cylindrical and rotationally symmetrical first longitudinal region of said "unbalanced" workpieces can be ground with high accuracy in a manner suitable for economical mass production.

This object is achieved by a method in which a balancing mass is first of all attached to said workpiece and then the cylindrical first longitudinal region is ground by centerless cylindrical grinding, at least in a first longitudinal portion.

The method according to the invention has the advantage that the conventional and known machines for centerless cylindrical grinding can be used, cf. in this connection, for example, Dubbel, Taschenbuch für den Maschinenbau [Mechanical Engineering Handbook], 18th edition, pages T89/T90. In the present case, centerless cylindrical grinding is also of advantage because, for example, the balancer shafts mentioned can be produced in large numbers and are already in the form of forged or cast blanks and of very uniform quality after machining. Hence, the unbalance of the individual balancer shafts is therefore also within a relatively narrow range. It is thus possible with just a single type of balancing weight to achieve an economical process which allows a high degree of automation.

If the individual workpieces differ to a relatively great extent from one another, it is also possible to measure the residual unbalance thereof before grinding and to mount different balancing masses on the workpieces depending on requirements. In this way, the quality of the grinding process can be optimized even further. In general, the balancing masses are attached releasably to the workpieces. However, they do not have to be removed again immediately on completion of cylindrical grinding but can also be of advantage for additional production processes. For example, an appropriately dimensioned and shaped balancing mass can also be used as a grip for an automatic production linkage device or an assembly process. Moreover, the balancing mass may be useful for stabilizing the workpiece in additional transfer and processing operations.

It is self-evident that complete balancing in the precise physical sense does not always occur in series production when using a single type of balancing mass. However, it is sufficient for practical purposes if the remaining unbalance is reduced to a very low level.

For ease of explanation, the following terminological definitions. The first or second "longitudinal region" is the sum of the individual first and second longitudinal portions on the workpiece. For example, the balancer shaft illustrated by way of example in FIGS. 1 and 2 of this application has three first longitudinal portions, which can serve as bearings in subsequent operation and together form the first longitudinal region. Similar statements apply to the second longitudinal region, which is not rotationally symmetrical. It is unnecessary to grind all the first longitudinal portions of the first longitudinal region in every case.

In a case where the balancing mass is suitable only for the grinding process itself, the balancing mass is attached to the workpiece releasably and is removed as soon as the first longitudinal region thereof has been ground to the extent necessary by centerless cylindrical grinding.

In many cases, it will be advantageous that the balancing mass be attached in the second longitudinal region of the workplace. The cylindrical portions of the first longitudinal region are then all free for cylindrical grinding.

Another advantageous embodiment relates to the case where the first and second longitudinal portions alternate with one another on the workpiece and where a second longitudinal portion is formed by a bridge portion which extends between two first longitudinal portions and at a radial distance from the longitudinal axis. In this case, there is the possibility of mounting the balancing mass in a balancing body, which has a recess extending radially with respect to the longitudinal axis thereof. By means of this recess, the balancing body is mounted on the bridge portion and secured in the mounted position.

The means of securing the balancing weight can consist in a spring-loaded pressure pin but can also be formed by one or more screwed joints, by spring action latching members, a device for snap-on mounting, a magnetic joint or a multi-part embodiment of the balancing weight in which laterally applied clamping rings hold the individual parts together in the mounted state.

If two or more rotationally symmetrical first longitudinal portions are to be ground on the workpiece to be ground, grinding can be performed with a centerless cylindrical grinding machine which has a dedicated grinding set for each individual longitudinal portion, said set comprising a regulating wheel, a grinding wheel and a support rail. In this way, all the first longitudinal portions can be ground simultaneously.

For the combination of a particular workpiece of the type under discussion here with its associated balancing mass, there are a large number of different ways of assembling the balancing mass in the form of an appropriate balancing body with the workpiece, at least for the duration of the grinding process. Since this assembled subassembly is then fed to the grinding machine, the unit comprising the workpiece and the balancing body is referred to as a system, which is adapted to the nature of the workpiece and the particular grinding task. This system forms an important subassembly which passes as a joint unit at least through the grinding machine and, in many cases can also remain as such at subsequent stages.

An advantageous characteristic of this system can consist in that the balancing body is mounted releasably on the workpiece.

It is furthermore an advantageous characteristic of the system if the workpiece and the balancing body are assembled by means of a recess extending radially in the balancing body, wherein the balancing body is mounted by means of the recess on an eccentrically arranged longitudinal web of the workpiece.

If the preconditions for an automated method of working are met, a dedicated apparatus for cylindrical grinding of the system may be effected. This expresses the fact that the system can be machined as a whole in the centerless cylindrical grinding machine. In this case, one specific adaptation can consist in that there must be sufficient space for the rotation of the balancing weight.

In simple cases and at low production numbers, the balancing weight will be mounted individually and by had on the workpiece. If, however, the preconditions for mass production are met, it makes more sense for the assembly and, if appropriate, disassembly of the system to be performed automatically within the apparatus or in direct functional association therewith. In this way, a combined processing station can be effected, to which the workpieces are brought in a preprocessed state on a conveyor belt and are transferred from the conveyor belt into an assembly station and, from there, transferred again to the machine for centerless cylindrical grinding by loading gantries. The fully ground workpieces are also transferred back to the conveyor belt by loading gantries, and a station for removal of the balancing weights may also be provided, if appropriate.

The invention is explained in greater detail below in the illustrative embodiments with reference to drawings.

DETAILED DESCRIPTION OF THE INVENTION

Figure 1A:
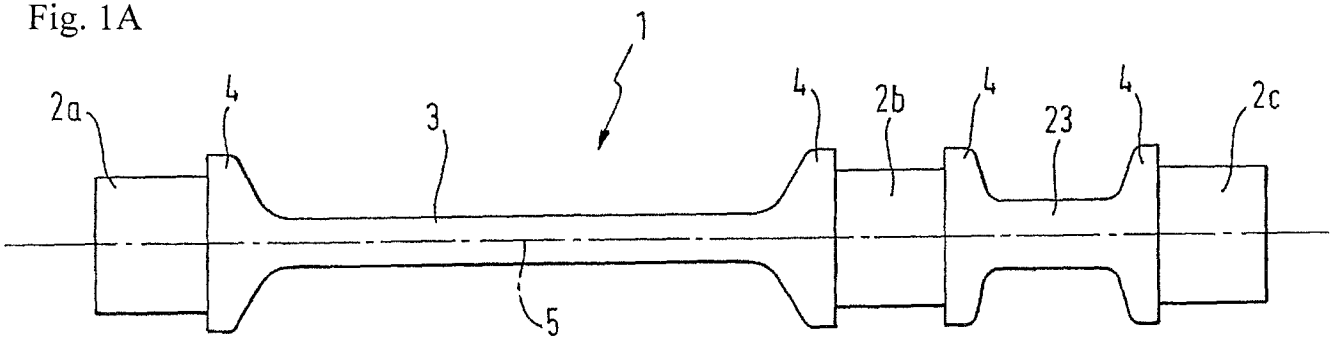
FIGS. 1A and 1B show two side views of a workplace which is to be ground in accordance with the proposal of the invention; in the FIG. 1B, the workpiece has been rotated by 90° about the longitudinal axis thereof relative to the FIG. 1A.
Figure 1B:
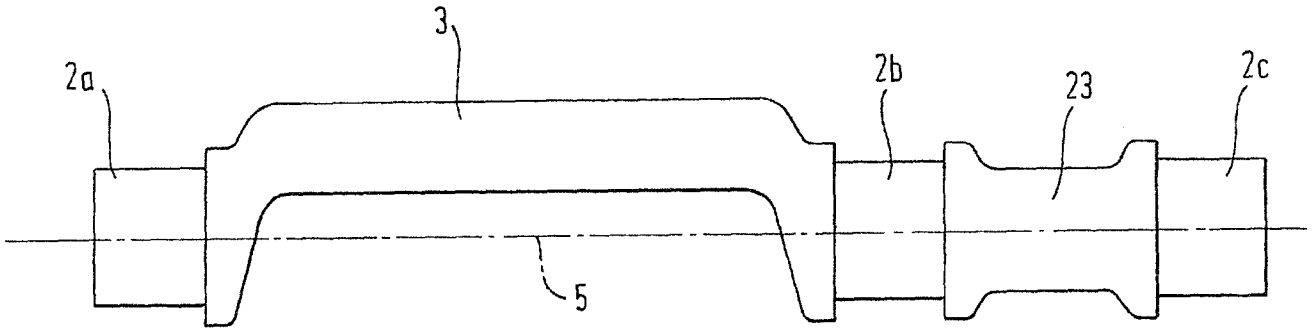

FIGS. 1A and 1B show two views of a balancer shaft of the kind increasingly being used on modern internal combustion engines. This balancer shaft is a good example of a workpiece 1 which can advantageously be ground by the method according to the invention. The workpiece 1 has a continuous longitudinal axis 5, by which the contour of the workpiece 1 is defined. In comparison with FIG. 1A, FIG. 1B has been rotated by 90° about the longitudinal axis 5. As can be seen from comparing FIGS. 1A and 1B, the workpiece 1 has first longitudinal portions 2*a*, 2*b*, 2*c*, which are cylindrical with respect to the continuous longitudinal axis 5 and can subsequently serve as bearing locations. Between the rotationally symmetrical first longitudinal portions 2*a* and 2*b* there is a second longitudinal portion 3, which departs from a rotationally symmetrical contour in cross section. Here, the second longitudinal portion 3 has an eccentric contour in the form of a flat longitudinal web, which in this case forms the bridge portion and extends at a radial distance parallel to the longitudinal axis 5. In contrast, a further longitudinal portion 23 has a cross section with the basic shape of a rectangle extending concentrically with the longitudinal axis 5. The different longitudinal portions 2*a*, 2*b*, 2*c*, 3 and 23 are separated from one another by flanges 4, which give rise to lateral abutment shoulders for the first longitudinal portions 2*a*, 2*b*, 2*c*.

According to the definitions hereinabove, the first longitudinal portions 2*a*, 2*b*, 2*c* together form the rotationally symmetrical first longitudinal region of the workpiece, while the second longitudinal portion 3 forms the second longitudinal region. In the latter, the radial distribution of mass in relation to the longitudinal axis 5 is nonuniform, giving rise to unbalance in the case of rotation.

Figure 2A:
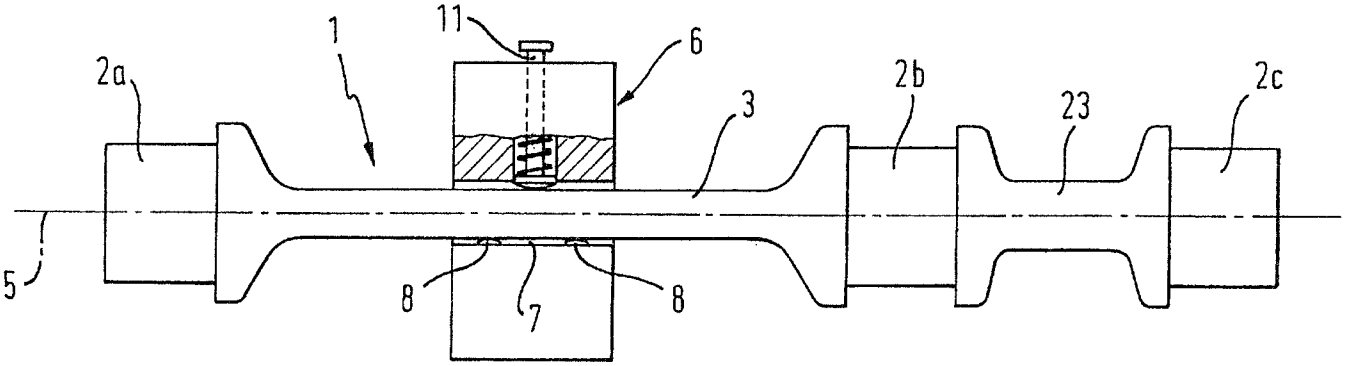
FIGS. 2A and 2B are illustrations corresponding to FIGS. 1A and 1B, respectively, in which a balancing body forming the balancing mass has been mounted on a second longitudinal portion.
Figure 2B:
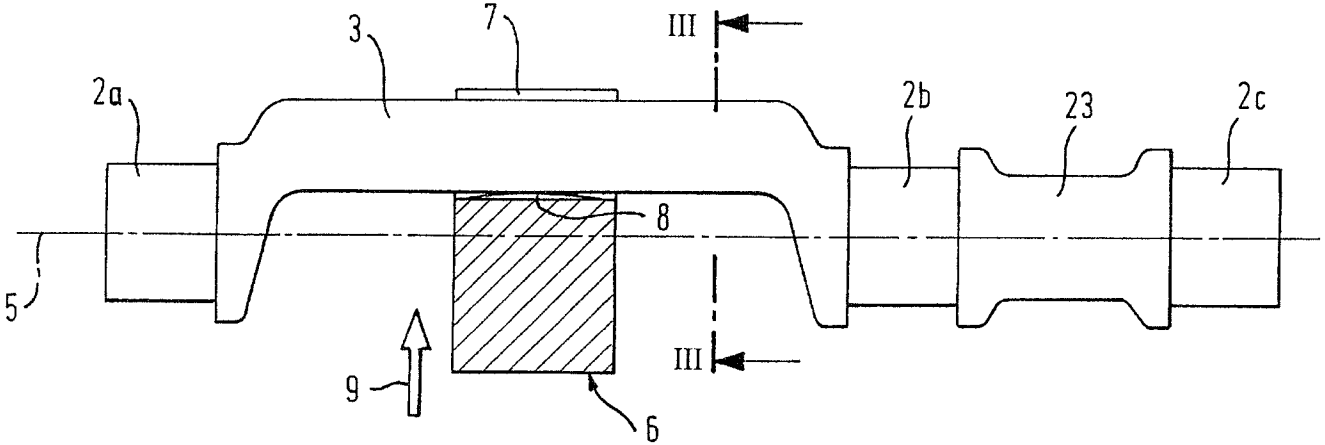
Figure 3B:
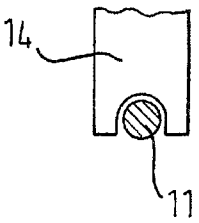
FIG. 3B is a partially sectional view through the pin showing also a pulling tool for pulling the pin by means of the head of the pin.
Figure 3A:
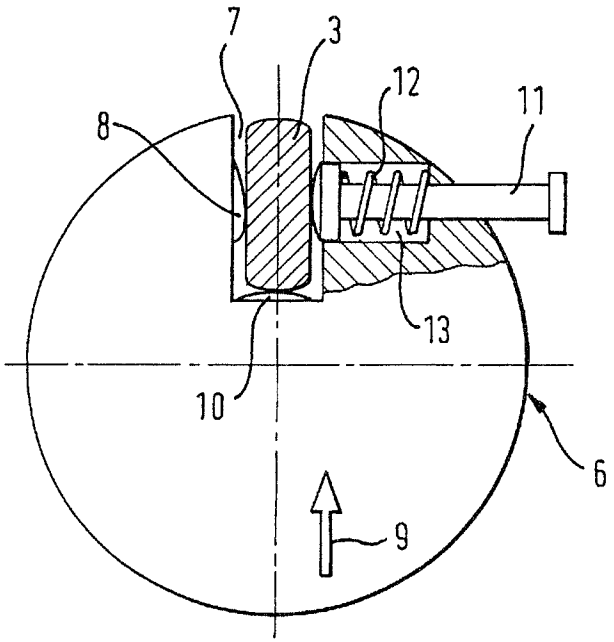
FIG. 3A represents a partially sectioned view in the direction of the line in FIG. 2.

FIGS. 2A and 2B correspond to FIGS. 1A and 1E, respectively, but with the difference that a balancing body 6 has been mounted on the second longitudinal portion 3. As is apparent from a combination of FIGS. 2A, 2B and 3A, the balancing body 6 has the basic shape of a circular disk, which is provided with a radially extending recess 7. The cross-sectional contour of the recess 7 has the basic shape of a rectangle, there being sliding ribs 8 on one side. A pressure pin 11 is supported in a sliding manner in a stepped bore 13 on the opposite, broad side of the recess 7 from the sliding ribs 8 and is preloaded toward the interior of the recess 7 by a helical spring 12.

By means of its recess 7, the balancing body 6 is mounted in the mounting direction 9 on the second longitudinal portion 3, which is designed as a flat longitudinal web and has the basic shape of a rounded rectangle. The narrow side of the recess 7 forms an abutment shoulder 10, against which the balancing body 6 abuts and is secured in this position by the pressure pin 11. It is readily apparent from FIGS. 2A, 2B and 3A that the balancing body 6 is mounted from the inside outward on the second longitudinal portion 3, starting from the longitudinal axis 5. During rotation of the workpiece 1 about the continuous longitudinal axis 5 thereof, the balancing body 6 is therefore pressed further against the second longitudinal portion 3 by the centrifugal force. The pressure pin 11 thus serves to secure the balancing weight 6.

Together with the balancing body 6, the workpiece 1 forms a common subassembly or system which, as a whole, has a balanced distribution of mass in the radial direction. The system is thus radially balanced in the conventional sense when it rotates about the continuous longitudinal axis 5.

Figure 4:
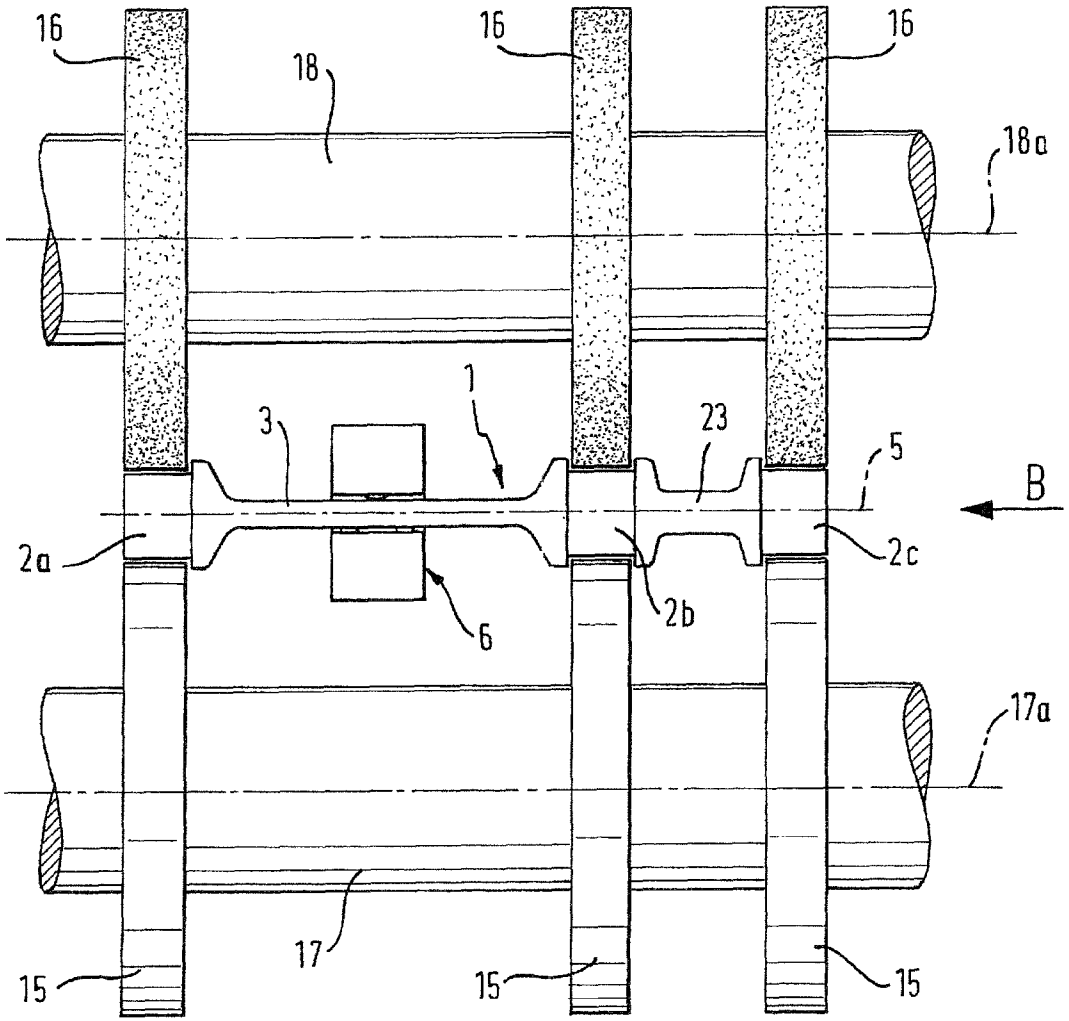
FIG. 4 is a schematic view from above of a grinding machine, by means of which all the rotationally symmetrical longitudinal regions of the workpiece are ground simultaneously.
Figure 5:
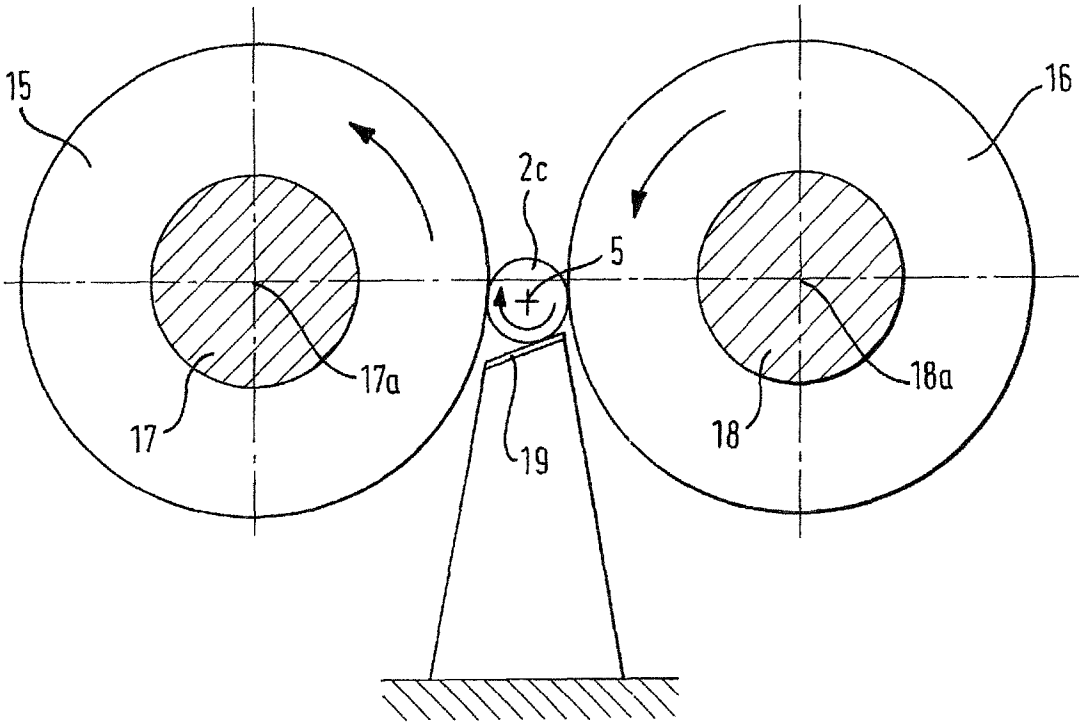
FIG. 5 shows a side view corresponding to FIG. 4.

FIGS. 4 and 5 then illustrate how the system is ground in an apparatus for centerless cylindrical grinding. In this process, a dedicated grinding set is provided for each of the first longitudinal portions 2*a*, 2*b*, 2*c*, said grinding set consisting in a known manner of a regulating wheel 15, a grinding wheel 16 and a support rail 19. The three parts mentioned together form a grinding gap, as shown in FIG. 5. The regulating wheel 15, the grinding wheel 16 and the workpiece 1 rotate in the same direction of rotation. Here, the longitudinal axis 5 of the workpiece 1 becomes the axis of rotation thereof and is below a connecting line drawn between the axes of rotation 17*a*, 18*a* of the regulating wheel 15 and the grinding wheel 16. The workpiece 1 is thus reliably pressed against the support rail 19, i.e. pressed into the grinding gap. The groups of regulating wheels 15 and grinding wheels 16 are each situated on a common regulating wheel shaft 17 or grinding wheel shaft 18 and are held at the correct distance from the workpiece 1 by corresponding spacers.

It should furthermore be noted that the figures for the illustrative embodiment are intended merely to illustrate the principle of the invention. Thus, for example, the balancing body 6 need not necessarily have the shape of a circular disk; a roller shape, an elliptical cross-sectional shape or some other shape may also be expedient. The figures primarily illustrate a centerless cylindrical grinding process based on the principle of perpendicular plunge-cut grinding. However, the invention is not restricted thereto, it is likewise possible to consider the other methods for centerless cylindrical grinding, such as longitudinal or throughfeed grinding or plunge-cut angle grinding.

The securing of the balancing weight 6 by a spring-loaded pressure pin 11 as illustrated in FIGS. 2 and 3 is likewise only one of many possibilities. One or more screwed joints, spring-action latching members, a snap-action joint, a magnetic joint or a multi-part embodiment of the balancing weight 6 in which laterally applied clamping rings hold the individual parts together in the mounted state could also be applied with the same success.

The balancing body 6 can be mounted manually on the second longitudinal portion 3*a*, in which case a fork-type pulling tool 14 (FIG. 3B) is then sufficient to pull out the pressure pin 11 by engaging the distal side of the head of the pin 11. However, consideration can also be given to automating the process of assembling the workpiece 1 and the balancing body 6 and to incorporating said process as a further function into the grinding apparatus or a suitable station additional thereto. At the same time, a combined machining station of the kind illustrated schematically in FIG. 6 may be advantageous.

Figure 6:
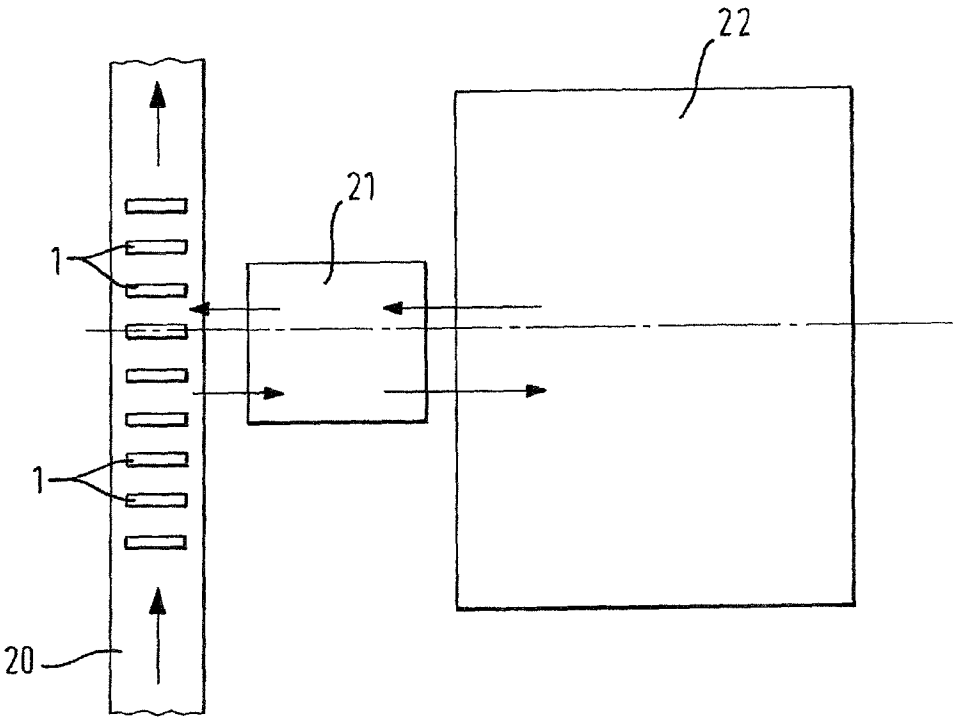
FIG. 6 illustrates the principle of a combined machining station in which the method according to the invention can be carried out to advantage.

According to FIG. 6, the workpieces 1 are first of all fed in on a conveyor belt 20 to an assembly station 21 in the preprocessed state. There, each workpiece 1 is provided in an automated process with its associated balancing body 6, i.e. the system mentioned is formed. This system is then fed to the centerless cylindrical grinding machine 22, in which one or more rotationally symmetrical longitudinal portions 2*a*, 2*b*, 2*c* of workpiece 1 are cylindrically ground in accordance with FIGS. 4 and 5. The system —consisting of the workpiece 1, which is now a finished part, and the balancing weight 6 —is then fed back to the conveyor belt 20 and to the next machining or assembly stage. This conclusion of the grinding method is expedient where the balancing weight 6 is also advantageous for the further progress of production. It is also conceivable that further functional parts which are required in any case, being required for the subsequent operation of the workpiece 1, are mounted at the grinding stage and are additionally configured in an appropriate manner as a balancing weight. If such functions are not required, it is also possible for the balancing weight 6 to be removed again from the workplace 1 immediately after grinding. The assembly station 21 must then be supplemented by a disassembly station.

The invention brings the advantage that the customary and existing machines for centerless cylindrical grinding can be used unmodified. If, namely, the balancing weight 6 is correctly dimensioned and arranged, the workpiece 1 will rotate smoothly and concentrically in the machine, making it possible to achieve a good grinding result without further ado.

The invention claimed is:

1. A method for cylindrical grinding of a one-piece workpiece, a contour of which is defined by a continuous longitudinal axis and, in addition to a first longitudinal region, which is rotationally symmetrical with respect to said longitudinal axis and comprises a plurality of first longitudinal portions which are separated from one another in the longitudinal direction of the workpiece, has a second longitudinal region, in which radial distribution of mass in relation to the longitudinal axis is non-uniform and which comprises a plurality of second longitudinal portions which are separated from one another in the longitudinal direction of the workpiece, wherein first longitudinal portions and second longitudinal portions alternate with one another and at least one second longitudinal portion is formed by a bridge portion which extends between two first longitudinal portions and to a radial distance from the longitudinal axis, the method comprising mounting a balancing body, which forms a balancing mass, on the bridge portion by means of a recess provided in the balancing body and securing the balancing body in a mounted position on the workpiece, and then grinding at least a first longitudinal portion of the first longitudinal region by cylindrical grinding, wherein the recess in the balancing body extends radially with respect to the longitudinal axis and in a mounting direction extending radially with respect to the longitudinal axis, and the grinding is performed by centerless cylindrical grinding, wherein said first longitudinal portion is situated in a grinding gap formed by a regulating wheel, a grinding wheel and a support rail.

2. The method as claimed in claim 1, wherein each of said longitudinal portions is situated in a respective grinding gap formed by a respective regulating wheel, a respective grinding wheel and a respective support rail, and all the first longitudinal portions are ground simultaneously.

3. A system for carrying out the method for cylindrical grinding of claim 1, the system comprising a one-piece workpiece configured to rotate 360 degrees about a longitudinal axis, and at least one balancing body having a radially extending recess, and being configured to rotate 360 degrees about the longitudinal axis with the workpiece, wherein a contour of the workpiece is defined by said longitudinal axis and, in addition to a first, rotationally symmetrical longitudinal region comprising a plurality of first longitudinal portions which are separated from one another in the longitudinal direction of the workpiece, the workpiece also has a second longitudinal region, in which radial distribution of mass in relation to the longitudinal axis is non-uniform and which comprises a plurality of second longitudinal portions, said longitudinal axis being continuous, wherein first longitudinal portions and second longitudinal portions alternate with one another, wherein at least one second longitudinal portion is formed by a bridge portion which extends between two first longitudinal portions and to a radial distance from the longitudinal axis, and wherein the at least one balancing body forms a balancing mass and is mounted releasably on the bridge portion by means of the radially extending recess, is secured in a mounted position and is configured to effect a uniform radial distribution of mass of the overall workpiece during 360 degree rotation of the workpiece and balancing body about said longitudinal axis.

4. The system as claimed in claim 3, further comprising a spring-loaded pressure pin situated on the balancing body for effecting the securing of the balancing body throughout said method.

5. A system for carrying out the method of claim 1, the system comprising a one-piece workpiece, and at least one balancing body having a radially extending recess, wherein a contour of the workpiece is defined by a continuous longitudinal axis and, in addition to a first, rotationally symmetrical longitudinal region comprising a plurality of first longitudinal portions which are separated from one another in the longitudinal direction of the workpiece, the workpiece also has a second longitudinal region, in which radial distribution of mass in relation to the longitudinal axis is non-uniform and which comprises a plurality of second longitudinal portions, wherein first longitudinal portions and second longitudinal portions alternate with one another, wherein at least one second longitudinal portion is formed by a bridge portion which extends between two first longitudinal portions and to a radial distance from the longitudinal axis, wherein the at least one balancing body forms a balancing mass and is mounted releasably on the bridge portion by means of the radially extending recess, is secured in a mounted position and effects a uniform radial distribution of mass of the overall workpiece, and wherein the balancing body is multi-part and laterally applied clamping rings hold individual parts of the balancing body together when the balancing body is in the mounted position, thereby securing the balancing body in the mounted position.

* * * * *